US009821322B2

(12) United States Patent
Hornung

(10) Patent No.: US 9,821,322 B2
(45) Date of Patent: Nov. 21, 2017

(54) CENTRIFUGAL SEPARATOR HAVING A PARTICLE GUIDE TROUGH

(75) Inventor: Dirk Hornung, Muenster (DE)

(73) Assignee: Hengst SE & Co. KG, Muenster (DE)

( * ) Notice: Subject to any disclaimer, the term of this patent is extended or adjusted under 35 U.S.C. 154(b) by 756 days.

(21) Appl. No.: 13/812,985

(22) PCT Filed: Jul. 20, 2011

(86) PCT No.: PCT/EP2011/062414

§ 371 (c)(1),
(2), (4) Date: Jan. 29, 2013

(87) PCT Pub. No.: WO2012/013550

PCT Pub. Date: Feb. 2, 2012

(65) Prior Publication Data

US 2013/0123090 A1 May 16, 2013

(30) Foreign Application Priority Data

Jul. 30, 2010 (DE) ..... 10 2010 038 701
Jan. 28, 2011 (DE) ..... 10 2011 009 741

(51) Int. Cl.
*B04B 5/08* (2006.01)
*B04B 7/02* (2006.01)
*B04B 5/12* (2006.01)

(52) U.S. Cl.
CPC ..... *B04B 5/08* (2013.01); *B04B 5/12* (2013.01); *B04B 7/02* (2013.01); *B04B 2005/125* (2013.01)

(58) Field of Classification Search
CPC .... B04B 5/08; B04B 5/12; B04B 7/02; B04B 7/04; B04B 2005/125
(Continued)

(56) References Cited

U.S. PATENT DOCUMENTS 1,914,764 A * 6/1933 Williams ..... B04B 1/00 494/43
5,791,490 A * 8/1998 Heinemann et al. ..... 209/148
(Continued)

FOREIGN PATENT DOCUMENTS

EP 2020485 2/2009
EP 2020485 A2 * 2/2009 ..... F01M 13/04
(Continued)

OTHER PUBLICATIONS

EP 2020485 Espacenet Machine Translation.*

*Primary Examiner* — Charles Cooley
*Assistant Examiner* — Shirley S Liu
(74) *Attorney, Agent, or Firm* — Greer, Burns & Crain, Ltd.

(57) ABSTRACT

A centrifugal separator for separating non-gaseous particles from a gas flow having a separator housing enclosing a rotor with a raw gas inlet, a clean gas outlet, and a particle outlet. A circumferential wall encloses the rotor. A raw gas flow is guided axially into the rotor. A clean gas flow is guided out of the rotor and then between the rotor and the circumferential wall to the clean gas outlet. The rotor comprises particle separation elements so that particles separated from the gas flow are centrifuged onto the circumferential wall. The circumferential wall particles are guided to the particle outlet via at least one particle guide trough running diagonal to the rotor axial direction on the interior of the circumferential wall. A radius of each trough as well as the distance between the rotor and the circumferential wall decreases in the direction of the clean gas flow.

18 Claims, 9 Drawing Sheets

(58) Field of Classification Search
USPC ..... 494/60
See application file for complete search history.

(56) References Cited

U.S. PATENT DOCUMENTS

| | | | | |
|---|---|---|---|---|
| 2005/0086915 | A1* | 4/2005 | Greif et al. | 55/356 |
| 2005/0242215 | A1* | 11/2005 | Eisinger | 241/20 |
| 2007/0163215 | A1 | 7/2007 | Lagerstadt | |
| 2011/0281712 | A1* | 11/2011 | Schlamann et al. | 494/7 |
| 2011/0294642 | A1* | 12/2011 | Murayama et al. | 494/14 |

FOREIGN PATENT DOCUMENTS

| | | | | |
|---|---|---|---|---|
| WO | WO2005032723 | | 4/2005 | |
| WO | WO2010051994 | | 5/2010 | |
| WO | WO 2010051994 | A1 * | 5/2010 | B01D 45/14 |

* cited by examiner

CENTRIFUGAL SEPARATOR HAVING A PARTICLE GUIDE TROUGH

RELATED APPLICATIONS

This application claims benefit of German patent application No. 10 2010 038 701.0, filed Jul. 30, 2010 and German patent application No. 10 2011 009 741.4, filed Jan. 28, 2011, the entire disclosures of which are herein incorporated by reference.

BACKGROUND OF THE INVENTION

The invention relates to a centrifugal separator for separating liquid and/or solid particles from a gas flow, having a separator housing and having a rotor which can be set into rotation arranged therein, wherein the separator housing has a raw gas inlet, a clean gas outlet and a particle outlet as well as a circumferential wall which radially encloses the outside of the rotor at a distance therefrom, wherein a raw gas flow can be axially guided into the rotor and set into rotation therein, wherein a clean gas flow can be guided away radially out of the rotor and then between the outer circumference of the rotor and the inner circumference of the circumferential wall to the clean gas outlet, wherein the rotor has particle separation elements, by means of which particles which have been separated from the gas flow can be thrown off onto the inner circumference of the circumferential wall by centrifugal force, wherein the particles on the circumferential wall can be fed to the particle outlet and wherein at least one particle guide trough which runs at an angle to the axis direction of the rotor is arranged on the inner circumference of the circumferential wall.

A centrifugal separator of the kind mentioned above is disclosed in WO 2010/051994 A1. This separator has been proven in practice, but the relatively high manufacturing cost associated therewith is seen as disadvantageous. The high manufacturing cost results particularly from the fact that the circumferential wall with the particle guide trough can only be manufactured in one piece as an injection molded part or diecast part with the help of an elaborately designed injection mold with a spindle core. A disadvantage is also seen in that the circumferential wall with the particle guide trough is inserted in the separator housing as a separate sleeve, which gives rise to increased assembly cost. Furthermore, it has been shown in trials with this centrifugal separator that fine particles in particular are not separated from the gas flow in the desired quantity and with the desired efficiency.

A further centrifugal separator is disclosed in WO 2005/032723 A1. With this separator, a plurality, preferably between 5 and 40, of particle guide troughs which extend over at least the upper half of the rotor are provided on the circumferential wall, which leads to a higher manufacturing cost. Preferably, it is also provided here that the circumferential wall widens conically in the flow direction of the clean gas flow so that the distance between the outer circumference of the part of the rotor which throws off the particles and the inner circumference of the circumferential wall becomes greater towards the clean gas outlet in flow directions of the clean gas flow. As is known from trials with centrifugal separators of this kind, larger particles are predominantly thrown off in the lower part of the rotor while the thrown-off particles in the upper part of the rotor are smaller. As is also known, smaller particles have a lower inertia than larger particles which, in the case of this known centrifugal separator, leads to small particles thrown-off in the upper region of the rotor not reaching the circumferential wall due to the relatively large distance here but being carried to the clean gas outlet with the clean gas flow in an undesirable manner. This centrifugal separator therefore does not achieve optimal efficiency with regard to fine particles.

SUMMARY OF THE INVENTION

The object of the present invention is therefore to create a centrifugal separator of the kind mentioned in the introduction which avoids the disadvantages stated and which achieves a high separation efficiency, in particular also with regard to fine particles, wherein the centrifugal separator must be capable of being manufactured easily and cost effectively.

According to the invention this object is achieved with a centrifugal separator of the kind mentioned in the introduction which is characterized in that the/each particle guide trough is designed as a section of a conical spatial spiral, wherein the progression of the/each particle guide trough has a radius which decreases towards the clean gas outlet in the direction of the clean gas flow, and that the distance between the outer circumference of the rotor and the inner circumference of the circumferential wall becomes smaller towards the clean gas outlet in the direction of the clean gas flow.

With the invention, it is advantageously achieved that the distance between the outer circumference of the part of the rotor which throws off the particles and the inner circumference of the circumferential wall is smallest in the region of the centrifugal separator in which fine particles are thrown-off by the rotor. The fine particles must therefore only cover a relatively short path from the outer circumference of the rotor to the inner circumference of the circumferential wall. The consequence of this is that, in spite of their low inertia relative to the larger particles, the fine particles impinge reliably on the circumferential wall and are collected thereon and then guided away over its surface and through the particle guide trough or troughs. The larger particles with their larger inertia also impinge reliably on the circumferential wall over a larger distance between the outer circumference of the rotor and the inner circumference of the circumferential wall, to be then guided away in the same manner as the fine particles. As a result of the geometry of the particle guide trough or troughs according to the invention, on the one hand the desired distance variation between the outer circumference of the rotor and the inner circumference of the circumferential wall is achieved in combination with a rotor which is formed simply as a cylinder and, on the other hand, the discharge of the liquid and/or solid particles deposited on the circumferential wall is benefited and assisted. If the diameter of the rotor is constant in the parts thereof which throw off particles, the manufacture of the rotor is kept particularly simple. The varying distance over the height of the rotor between its outer circumference and the inner circumference of the circumferential wall can additionally be influenced by varying the outside diameter of the rotor.

According to the invention, it is further proposed that a measure of the reduction in the radius is sized depending on the width of the/each particle guide trough and on the number of particle guide troughs so that the circumferential wall with the separator housing which has at least one particle guide trough can be removed from the mold axially without undercuts when manufactured as an injection molded or diecast part. In doing so, the geometry of the/each guide trough, the number of them and the width of the/each guide trough measured in the radial direction, are in other words matched to one another such that, when viewed in the axial direction, there is no radial overlap between particle guide troughs. This enables the part of the centrifugal separator which has the particle guide trough or troughs to be produced easily and therefore cost effectively from the molding point of view, as the circumferential wall can be removed from the mold easily in an axial direction and without rotation when manufactured as an injection-molded or diecast part. A complicated mold with a spindle core is now no longer required.

An advantageous improvement of the centrifugal separator provides that the/each particle guide trough extends over less than the total height of the part of the rotor which throws off particles. Practical trials with the centrifugal separator according to the invention has shown that an arrangement of one or more particle guide troughs over only a portion of the height of the part of the rotor which throws off particles is also entirely adequate for the desired function. This enables the geometry of the circumferential wall to be further simplified, which also makes its manufacture correspondingly easier.

In order to be able to make full use of the natural gravitational force when the centrifugal separator is in operation, it is expediently provided that the clean gas outlet is arranged above the rotor in the separator housing, that the clean gas flow can be guided away between the outer circumference of the rotor and the inner circumference of the circumferential wall upwards to the clean gas outlet, and that the/each particle guide trough begins at the same height or above the top end of the part of the rotor which throws off particles and extends downwards therefrom. Here, the particles are guided away by a combination of the natural gravitational force and the gas flow produced by the rotor and guided by the particle guide troughs, which overall ensures that the particles deposited on the inner circumference of the circumferential wall are reliably guided away without them being able to find their way back into the gas flow.

As already described above, the distance between the outer circumference of the rotor and the inner circumference of the circumferential wall is greater in the region of the rotor which is remote from the clean gas outlet. As a result, a relatively larger flow cross section is provided and thus ensures relatively lower gas speeds in these regions. It is therefore relatively unlikely or even impossible that particles deposited on the circumferential wall will be carried along. For this reason, an embodiment of the invention proposes that the/each particle guide trough is continued downwards into a particle discharge trough which runs axially further downwards. The axial progression of the particle guide trough ensures the shortest possible path for guiding away the separated particles and makes the circumferential wall easier to manufacture.

An improvement provides that the distance between the outer circumference of the rotor and the inner circumference of the circumferential wall is constant over the range of height taken up by the axially running particle discharge trough. This embodiment is in particular a contribution to a compact design of the separator housing, as the increase in the outside diameter of the separator housing associated with the increasing distance between the rotor and the circumferential wall is no longer continued in this lower region.

In order to guide away particles deposited on the circumferential wall reliably and without the risk of re-entry into the gas flow, according to the invention, it is provided that the/each particle guide trough and/or particle discharge trough is undercut when viewed in cross section and is open in the opposite direction to the direction of rotation of the rotor and is formed steplessly and continuously with the inner circumference of the circumferential wall in the direction of rotation of the rotor. The particles are trapped in the undercut and are then adequately shielded from the clean gas flow flowing in the direction of the clean gas outlet. The steplessly continuous formation of the particle guide trough (s) with the inner circumference of the circumferential wall in the direction of rotation of the rotor prevents troublesome gas flow eddies which could loosen particles from the circumferential wall and effect a re-entry of the particles into the clean gas flow.

A further measure for achieving a simple production of the centrifugal separator according to the invention consists in that preferably the circumferential wall with the at least one particle guide trough is an integral part of the separator housing.

In doing so, in an improvement, it is provided that the part of the separator housing having the at least one particle guide trough is a housing cover which can be removed from the remaining separator housing. The centrifugal separator is then designed so that, in the case of the cover which is connected to the remaining separator housing, this encompasses the rotor or at least the part of the rotor which throws off particles. Advantageously, this also enables centrifugal separators to be easily provided with particle guide troughs and without particle guide troughs in that two different covers are made, wherein all remaining parts of the centrifugal In an alternative embodiment, the invention proposes that the circumferential wall with the at least one particle guide trough is a sleeve which is inserted in the separator housing. In this embodiment, differently designed sleeves can be fitted in otherwise identical separator housings in order to realize different designs, for example with regard to the arrangement and/or alignment and/or number of particle guide troughs, as simply as possible.

In a preferred embodiment, it is provided that a single particle guide trough, which preferably extends over 360° in the circumferential direction, is arranged on the inner circumference of the circumferential wall. As a result, the geometry of the circumferential wall becomes advantageously simple, and the degree of taper can be kept within tight limits, which benefits a compact design.

Alternatively, it is possible that n particle guide troughs, each preferably extending over 360°/n in the circumferential direction and not overlapping one another, are arranged on the inner circumference of the circumferential wall, wherein $n \geq 2$. A particularly compact design is possible as a consequence of the non-overlapping guide troughs. In a practical embodiment, the number n preferably lies between 2 and 8.

In order to achieve a good efficiency, the rotor is preferably a disc stack separator, which has already been proven in conventionally known centrifugal separators.

To enable the separated particles to be guided away in an orderly and concentrated manner, it is preferably provided that a circumferential particle collection trough which is connected to the particle outlet is arranged in the separator housing below an axial bottom end of the/each particle guide trough or particle discharge trough.

The centrifugal separator described above can be used for different applications. Its advantages are particularly well accentuated when the centrifugal separator is an oil mist separator for the crankcase exhaust gas of an internal combustion engine, in particular of a motor vehicle.

BRIEF DESCRIPTION OF THE DRAWINGS

Exemplary embodiments of the invention are explained below with reference to a drawing. The figures of the drawing show.

DETAILED DESCRIPTION OF THE PREFERRED EMBODIMENTS

Figure 1:
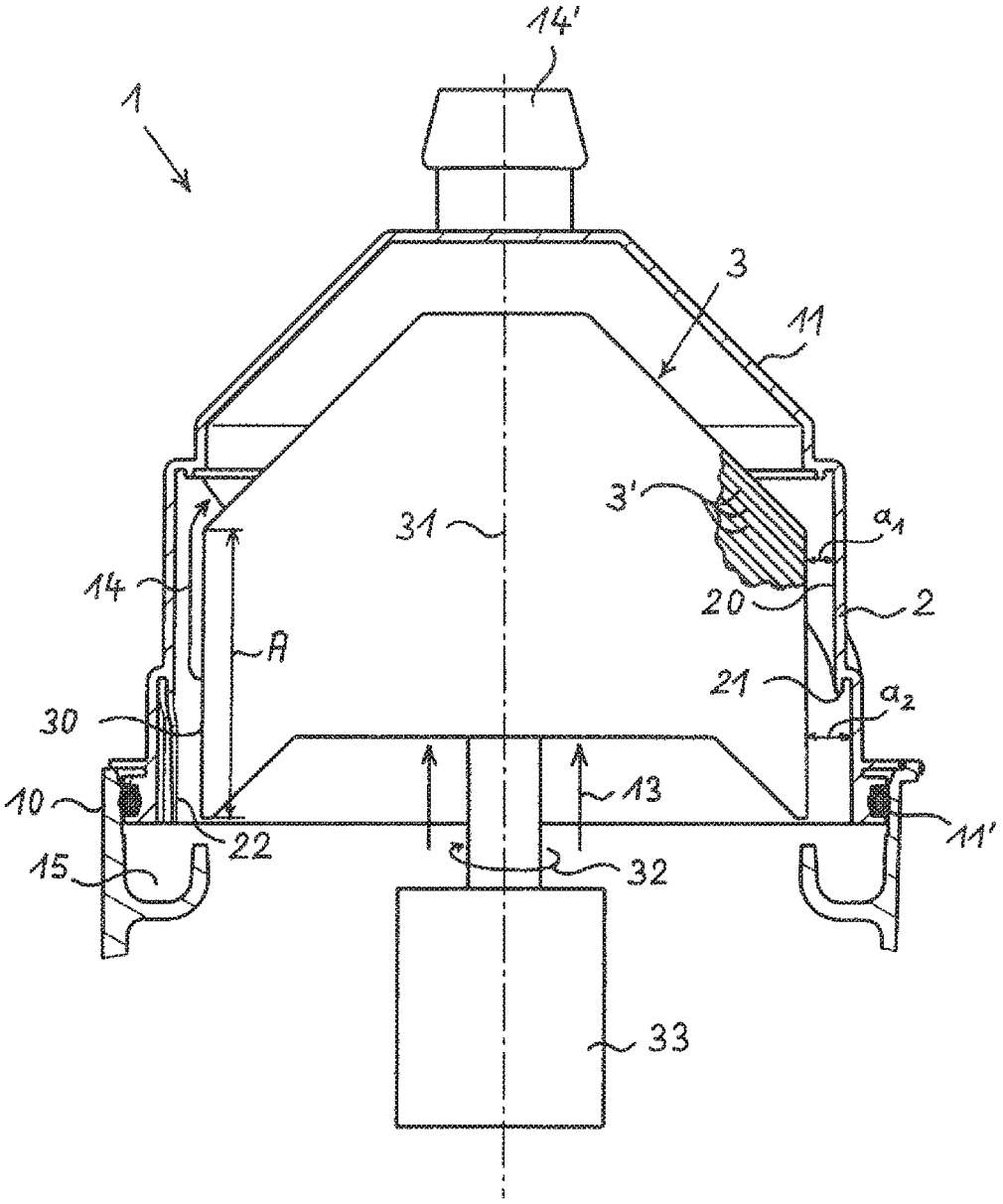
FIG. 1 a centrifugal separator in a longitudinal section.

FIG. 1 of the drawing shows a centrifugal separator 1 in a schematic diagram in a longitudinal section. The centrifugal separator 1 has a separator housing 10 which is only partially shown here. An upper part of the separator housing 10 is formed by a housing cover 11 which is releasable and connected to the remaining separator housing 10 while interposing a sealing ring 11'. A rotor 3, which for example is formed by a disc stack 3' as is known per se, is arranged inside the separator housing 10, here inside the housing cover 11. The rotor 3 can be set into rotation about an axis of rotation 31 with the direction of rotation 32 by means of a drive 33 arranged in the separator housing below the rotor 3.

A raw gas flow 13 carrying particles to be separated, for example the crankcase exhaust gas of an internal combustion engine containing oil mist, is fed axially into the rotor 3 from below. The gas flow is deflected outwards in a radial direction within the rotor 3 and then leaves the rotor 3 at its outer circumference 30 in the height range A. Particles fed into the raw gas flow 13 are first separated from the gas flow by deflecting the flow at surfaces present within the rotor 3 and then thrown off outwards by centrifugal force, as a result of which the particles are deposited on the inner circumference 20 of the circumferential wall 2 of the housing cover 11. The gas which has been freed from particles flows upwards as clean gas 14 through the annular gap between the outer circumference 30 of the rotor 3 and the inner circumference 20 of the circumferential wall 2 to a clean gas outlet 14', which here is arranged in the center of the cover 11.

One or more, four in the example according to FIG. 1, particle guide troughs 21 are provided on the inner circumference 20 of the circumferential wall 2, in this case molded on in one piece. The particle guide troughs 21 each run spirally from top to bottom viewed in the direction of rotation 32 of the rotor 3, wherein the diameter of the circumferential wall 2 and therefore also the radius of the particle guide troughs 21 arranged thereon at the same time increases from top to bottom. The gas flow in the annular gap between circumferential wall 2 and rotor 3 which is set into rotation by the rotating rotor 3 ensures that the particles deposited on the inner circumference 20 of the circumferential wall 2 are fed along the inner circumference 20 to the particle guide troughs 21 and then guided downwards at an angle along the particle guide troughs 21. In the downwards direction, each particle guide trough 21 merges into an axially running particle discharge trough 22 which in each case finally opens out into a particle collection trough 15 running around the separator housing 10 in the circumferential direction.

The distance a between the inner circumference 20 of the circumferential wall 2 and the outer circumference 30 of the rotor 3 is not constant viewed over the height A of the outer circumference 30 of the rotor 3 which throws off particles but becomes smaller in the flow direction of the clean gas flow 14, here seen from bottom to top. With the dimension a2, the said distance is greater in a lower region of the outer circumference 30 of the rotor 3 than in an upper region of the outer circumference 30 of the rotor 3 where the distance has the smaller dimension a1. As a result, a larger flow cross section is provided for the clean gas escaping from the rotor 3 in the lower region of the outer circumference 30 of the rotor 3, which ensures a lower gas flow speed in this region. This in turn makes it easier for the separated particles to be guided away downwards without the risk of particles deposited on the inner circumference 20 of the circumferential wall 2 ever finding their way unwanted into the clean gas flow 14 once more. The relatively large distance a2 is not a problem here, as predominantly large particles which have a large inertia, with which they can also overcome the relatively larger distance a2 without being picked up by the relatively slow clean gas flow 14 here, are thrown off in this lower region of the rotor 3.

Predominantly smaller and lighter particles are thrown off in the upper region of the outer circumference 30 of the rotor 3, for which it is of advantage that, with the dimension a1, the distance from the outer circumference 30 of the rotor 3 to the inner circumference 20 of the circumferential wall 2 is smaller here. As a result of this small distance a1, smaller and lighter particles also reliably reach the inner circumference 20 of the circumferential wall 2 in spite of their lower inertia and are thus likewise reliably separated from the gas flow.

Figure 2:
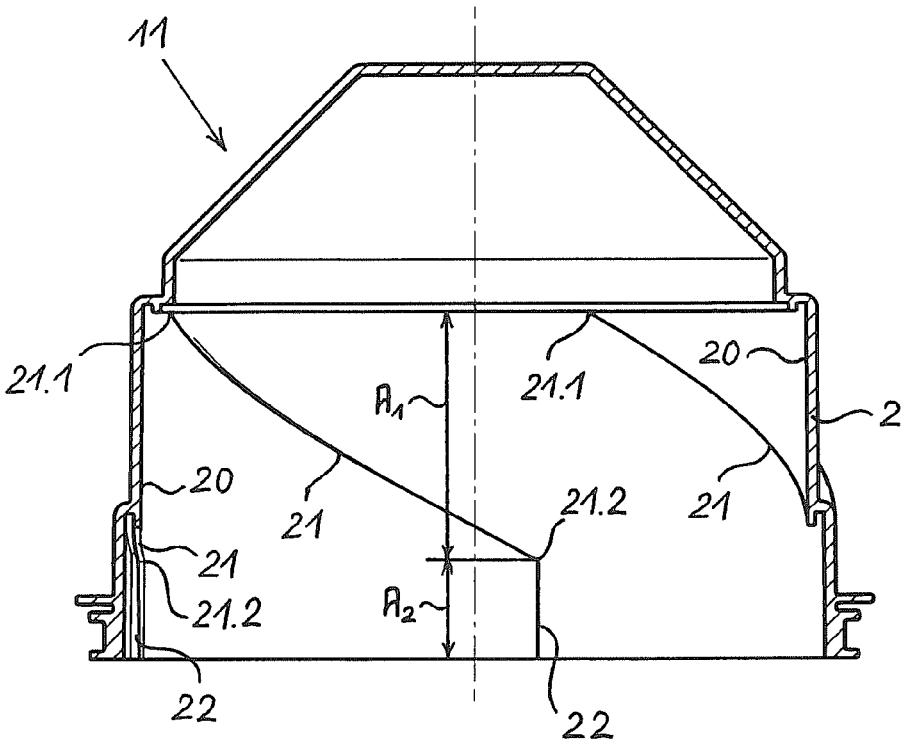
FIG. 2 a housing cover of the separator from FIG. 1 in a longitudinal section, FIG. 3 the housing cover from FIG. 2 in a view at an angle from below, FIG. 4 the housing cover from FIG. 3 in a view from below, FIG. 5 the housing cover in a modified design in a view at an angle from below, FIG. 6 the housing cover from FIG. 5 in a view from below, FIG. 7 a sleeve as part of the centrifugal separator in front view, FIG. 8 the sleeve from FIG. 7 in a view at an angle from below, FIG. 9 the geometric progression of a guide trough in the form of a conical spatial spiral in cylindrical coordinates, FIG. 10 a geometric development of a guide trough, FIG. 11 a schematic front view of the separator housing with four guide troughs connected to one another in the circumferential direction, FIG. 12 the separator housing from FIG. 11 in longitudinal section, and FIG. 13 a schematic front view of the separator housing with four guide troughs overlapping one another in the circumferential direction.

FIG. 2 of the drawing shows the housing cover 11 of the centrifugal separator 1 from FIG. 1 as a single part in longitudinal section. As a result of this, the particle guide troughs 21 arranged on the inner circumference 20 of the circumferential wall 2 and the particle discharge troughs 22 which continue them downwards now become visible. Each particle guide trough 21 has a beginning 21.1 at the top and an end 21.2 in the downwards direction after a height A1. Each particle discharge trough 22 extends over a height A2. The ratio of the heights A1 and A2 to one another can be changed as required and optimized by testing.

As FIG. 2 further shows, viewed in the circumferential direction, each particle guide trough 21 extends over somewhat less than 90° so that in each case two adjacent particle guide troughs 21 do not overlap one another in the circumferential direction, which enables a particularly compact design to be achieved.

Furthermore, FIG. 2 illustrates that each particle guide trough 21 at its side which points upwards at an angle and each particle discharge trough 22 at its side which points in the direction of rotation of the rotor is formed continuously and steplessly with the inner circumference 20 of the circumferential wall 2, as a result of which troublesome gas eddies are prevented or at least reduced.

The lower diameter of the inner circumference 20 of the circumferential wall 2 is greater than the diameter in the upper region of the circumferential wall 2. At the same time, expediently, the lower diameter is greater than the upper diameter to such an extent that the particle guide troughs 21 can be removed axially downwards and without undercuts from the mold when the housing cover 11 is manufactured as an injection molded part.

The lower diameter is the diameter up to which the particle guide troughs 21 are present in a downwards direction. No further tapering is required in the region below this where the spiral particle guide troughs 21 are no longer present but only the particle discharge troughs 22 which continue these axially in a straight line.

Figure 3:
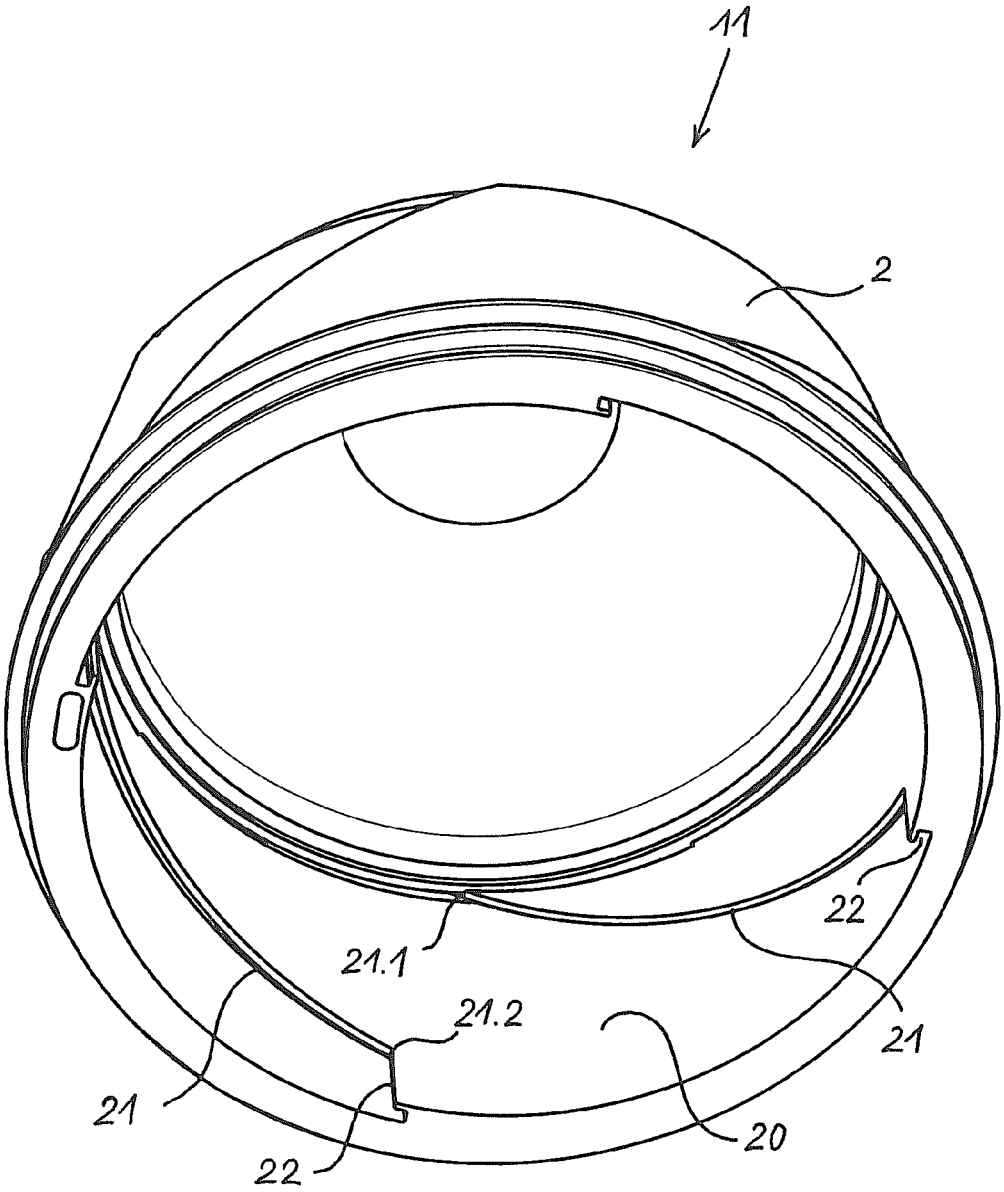

FIG. 3 of the drawing shows the housing cover 11 from FIGS. 1 and 2 in a view at an angle from below. Here, two of the four particle guide troughs 21 with their axial particle discharge troughs 22 which are connected to the bottom of each are visible on the inner circumference 20 of the circumferential wall 2. Here too it can be seen that each particle guide trough 21 has a beginning 21.1 at the top and an end 21.2 at the bottom. At the same time, the particle guide troughs 21 do not overlap one another viewed in the circumferential direction as each of the four particle guide troughs 21 in each case extends over somewhat less than 90° viewed in the circumferential direction. Likewise, it can be clearly seen in FIG. 3 that each particle guide trough 21 and particle discharge trough 22 is formed continuously and steplessly with the inner circumference 20 of the circumferential wall 2 viewed in the direction of rotation of the rotor.

Figure 4:
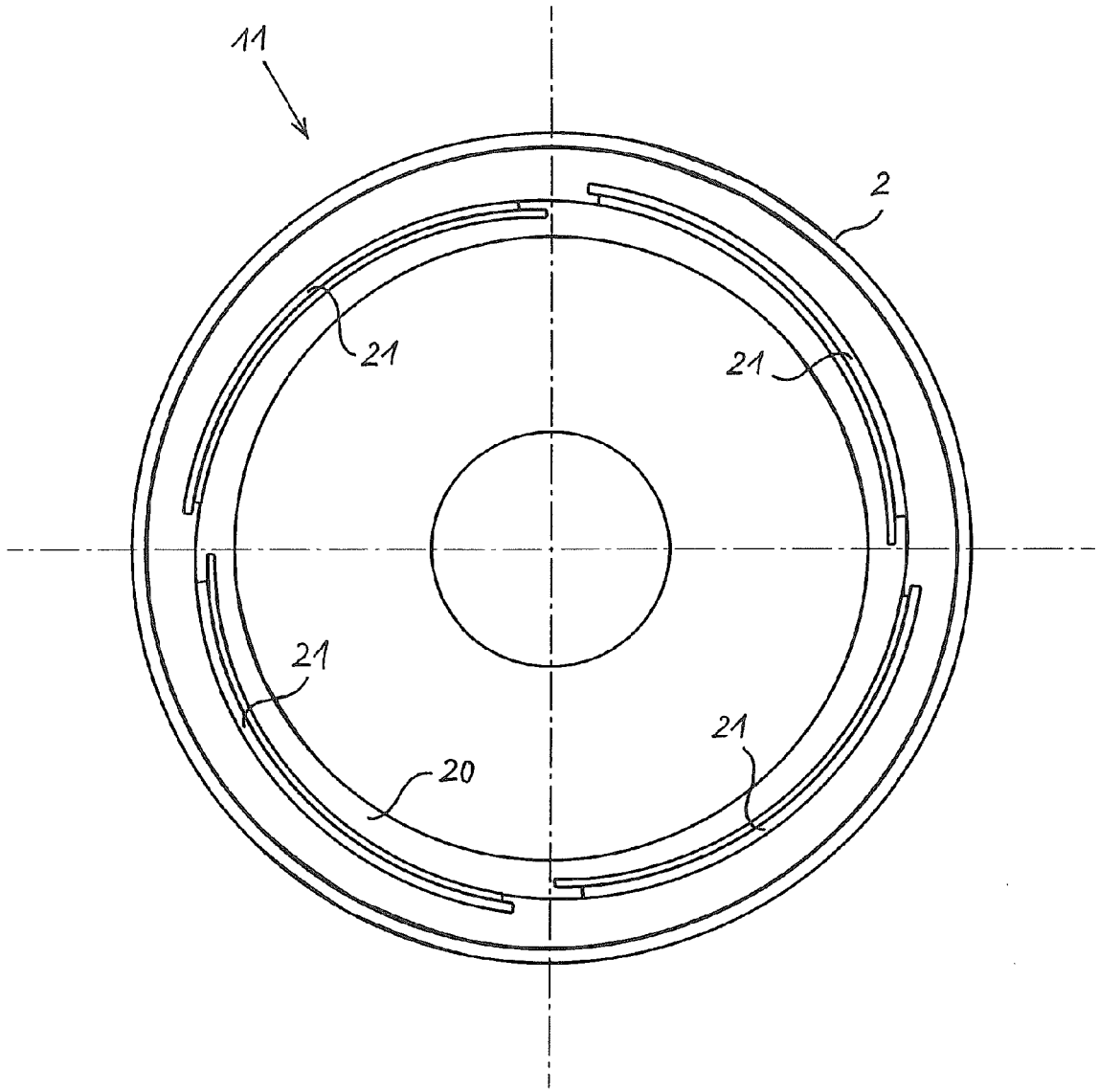

FIG. 4 of the drawing shows the housing cover 11 from FIG. 3 in a view from below. The circumferential wall 2 with its inwardly facing inner circumference 20 runs radially outwards. The four particle guide troughs 21, which in each case extend over somewhat less than 90° viewed in the circumferential direction, run on the inner circumference 20. The number of particle guide troughs 21 can of course also be less than four or greater than four.

Figure 5:
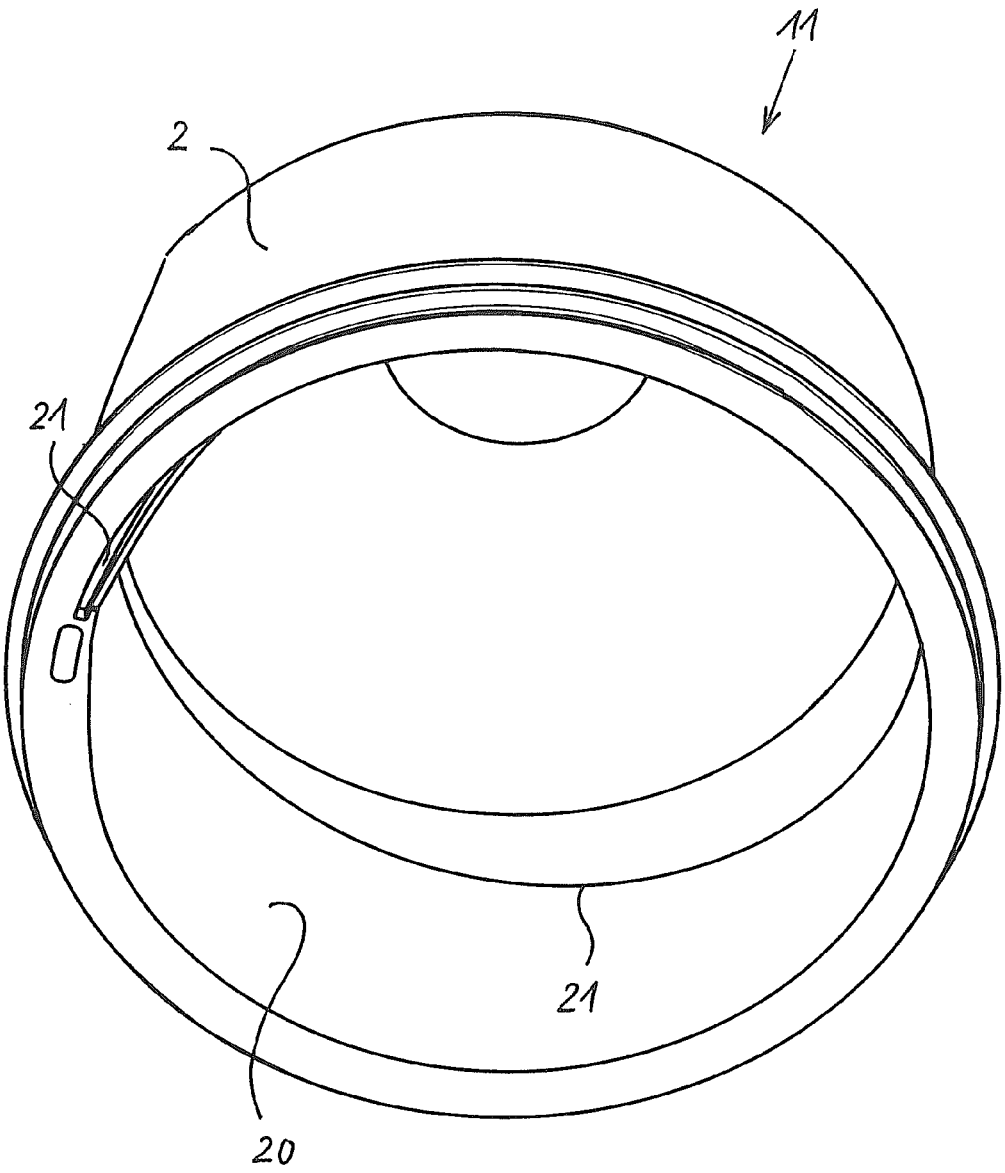
Figure 6:
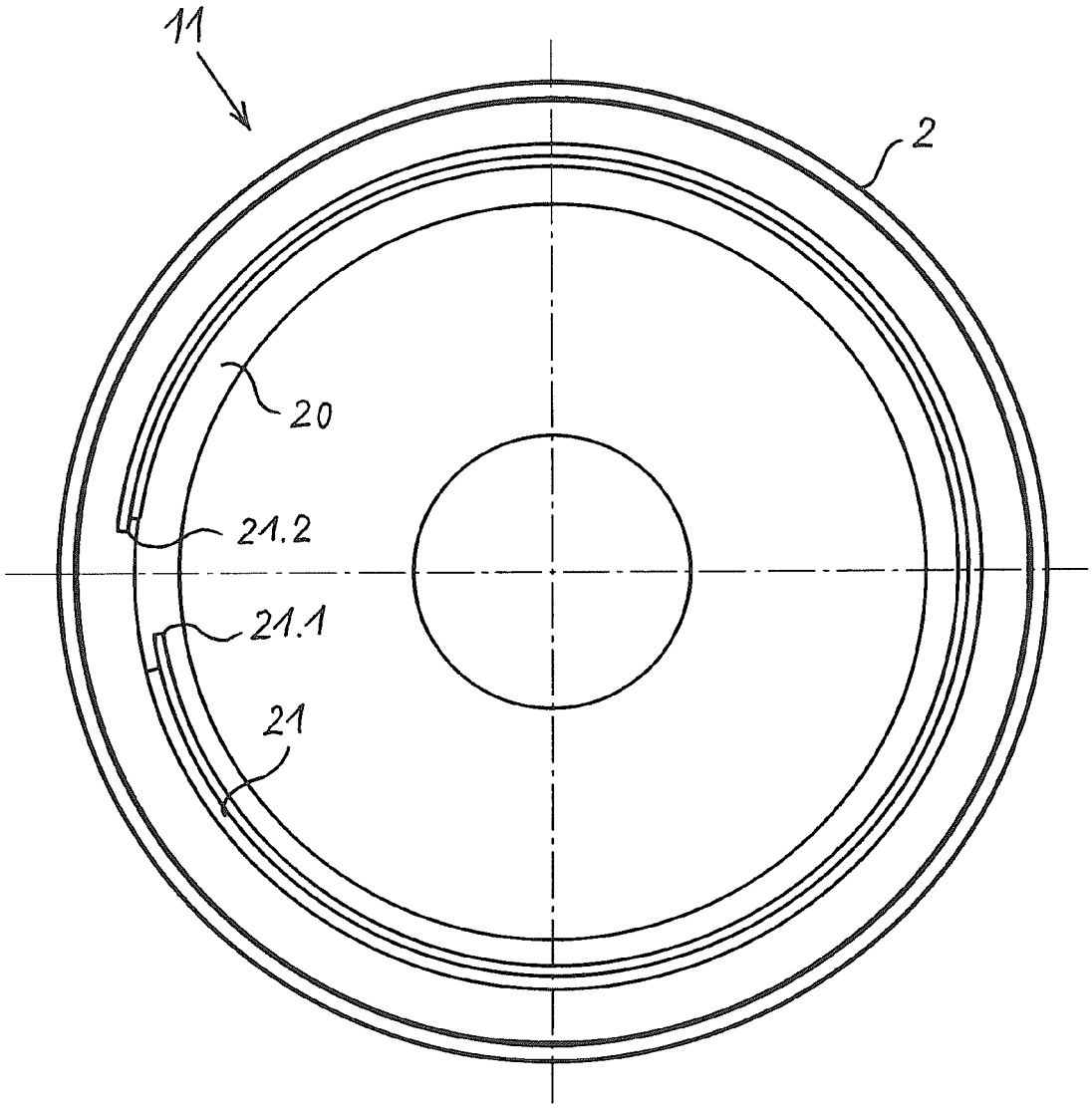

An example of an embodiment of the centrifugal separator or its housing 11 with a single particle guide trough 21 on the inner circumference 20 of the circumferential wall 2 is shown in FIGS. 5 and 6. The particle guide trough 21 thus has a relatively small pitch which, although it extends the path for the separated particles along the particle guide trough 21, overall makes for a smoother surface of the inner circumference 20 of the circumferential wall 2 and thus reduces troublesome gas eddies to a minimum.

The view from below of the housing cover 11 in FIG. 6 illustrates that, also in the case of the embodiment with only a single particle guide trough 21, its beginning 21.1 and its end 21.2 are spaced slightly apart in the circumferential direction in order to guarantee simple removal from the mold in an axial direction when the housing cover 11 is manufactured. Here too, the inside diameter of the inner circumference 20 of the circumferential wall 2 with the particle guide trough 21 becomes smaller from bottom to top, that is to say in the gas flow direction towards the clean gas outlet, in order to make the annular gap between the inner circumference 20 of the circumferential wall 2 and the outer circumference of the rotor narrower in the direction of the clean gas outlet when the centrifugal separator is assembled.

Figure 8:
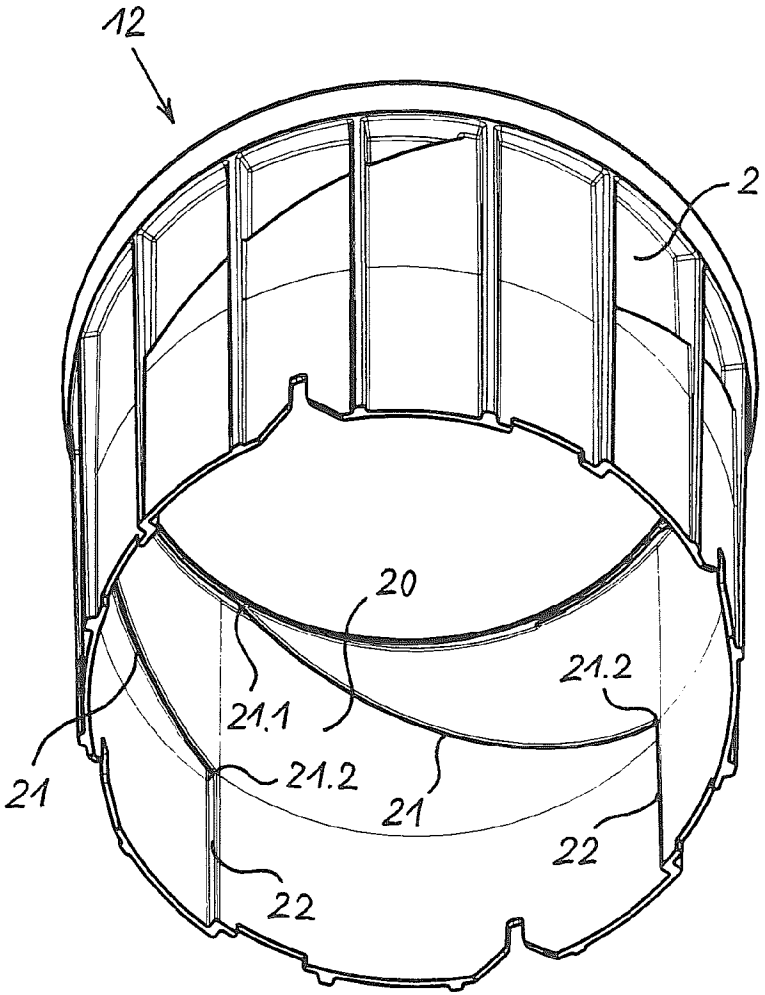
Figure 7:
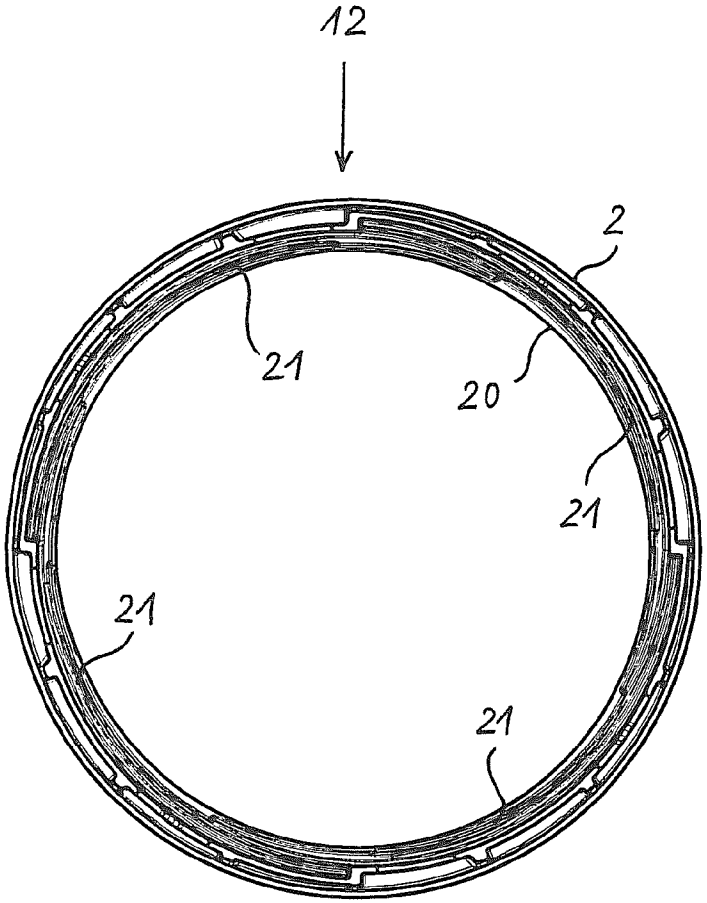

An exemplary embodiment, for which it is characteristic that the circumferential wall 2 with particle guide troughs 21 has the form of a separate sleeve 12 which is made as a single part and then inserted in the separator housing, is shown in FIGS. 7 and 8.

The front view in FIG. 7 shows the circumferential wall 2 radially outwards with its inner circumference 20 which faces radially inwards, on which here too four particle guide troughs 21 distributed in the circumferential direction are molded on in one piece.

The view in FIG. 8 shows the progression of the particle guide troughs 21 on the inner circumference 20 of the circumferential wall 2, wherein here each particle guide trough 21 again has a beginning 21.1 at the top and a lower end 21.2. From the bottom end 21.2 of each particle guide trough 21, an axially running particle discharge trough 22 leads down further to a bottom front end of the sleeve 12. At the same time, the inside diameter of the sleeve 12 above the particle guide troughs 21 is in each case less than below the particle guide troughs 21. This ensures that, even with the sleeve 12, the distance between the inner circumference 20 of the circumferential wall 2 and the outer circumference of the rotor becomes smaller towards the clean gas outlet in the gas flow direction in the assembled state of a centrifugal separator with the sleeve 12.

The sleeve 12 can likewise be manufactured in one piece as an injection molded part and in doing so can likewise easily be removed from the mold in an axial direction, as even with the sleeve 12 the particle guide troughs 21 do not overlap one another in the circumferential direction.

Here too, the transition of each particle guide trough 21 and each particle discharge trough 22 in the direction of rotation of the rotor is stepless and continuous in order to prevent troublesome gas eddies.

When the sleeve 12 is inserted into a separator housing, expediently a particle collection trough 15, as shown by way of example in FIG. 1, lies below the bottom front end of the sleeve 12.

Figure 9:
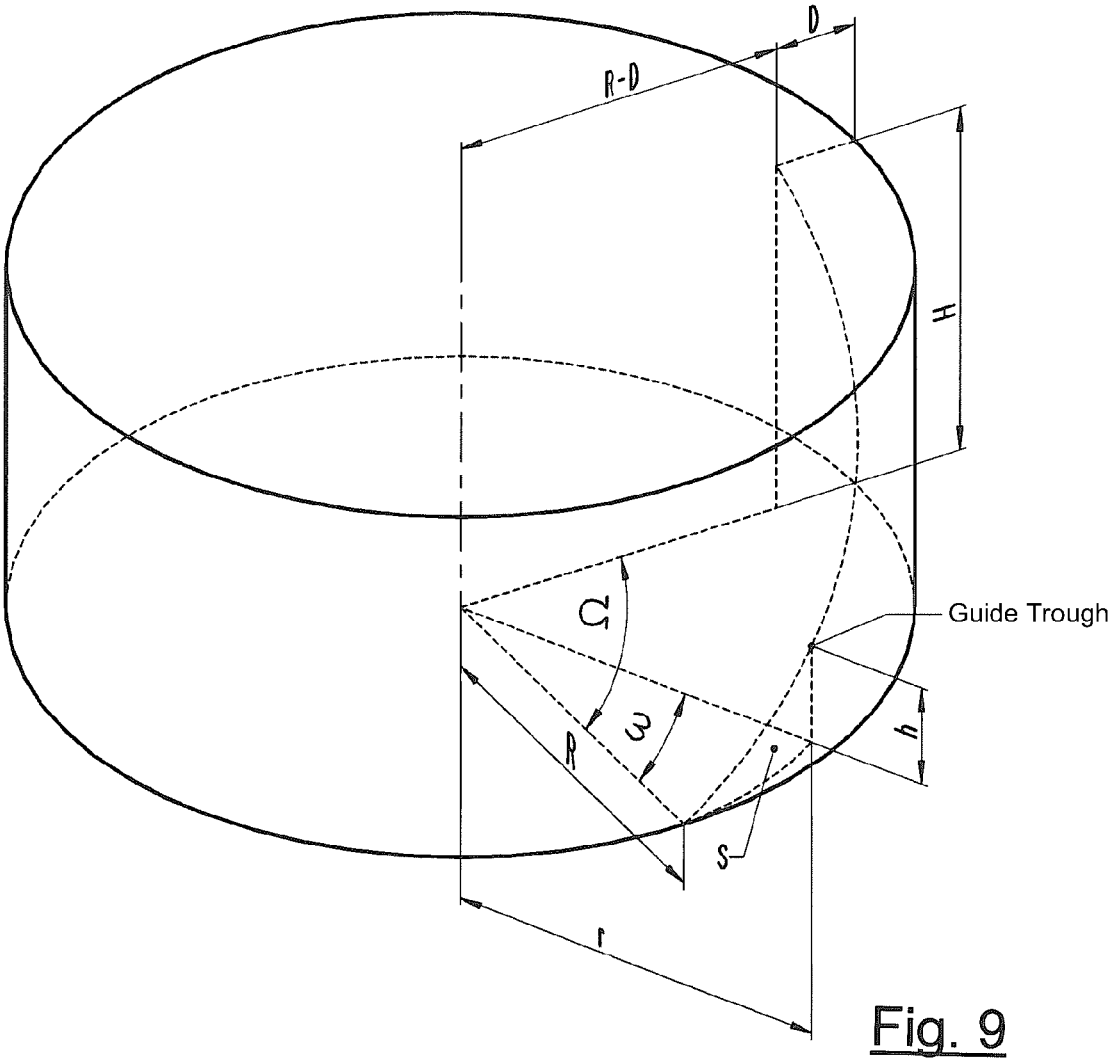
Figure 10:
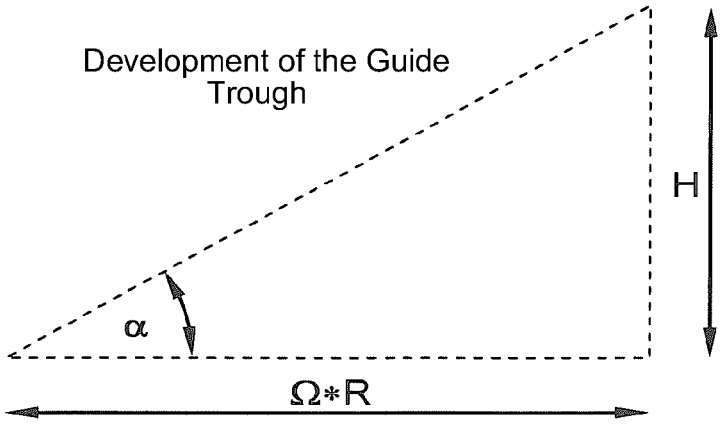

FIG. 9 of the drawing shows the progression of a guide trough geometrically as a conical spatial spiral in cylindrical coordinates and FIG. 10 shows a development of a guide trough geometrically. Here:

R=Start radius (=maximum radius) D=Change in radius

H=Overall height of guide trough Ω=Total angle of guide trough [rad]

S=Pitch of guide trough, and α=Helix angle of guide trough.

Under the assumption that R>>D, the following is approximately true:

$$S = \frac{H}{\Omega * R}$$

In practice, the value for the pitch S advantageously lies between 0.5 and 1, and the value for the helix angle α between 30° and 45°.

Also in FIG. 9:

h=Height of a point on the guide trough r=Radius of a point on the guide trough, and ω=Angle of a point on the guide trough [rad].

The angle ω and the radius r can then be expressed as a function of h as follows:

$$\omega(h) = \frac{h}{H} * \Omega \text{ and } r(h) = R - \frac{h}{H} * D$$

The demolding chamfers are small and are ignored in the following considerations; normal values are 0.5°-1° for plastic and 1°-3° for aluminum diecasting.

The progression of the guide trough(s) shown in FIG. 9 and described above has a radius R (=distance from central axis) which decreases in the clean gas flow direction. This change D in the radius can advantageously be chosen so that the component of the separator which has the guide trough or troughs, i.e. its housing or cover or also the sleeve, can be removed from the mold without undercuts in the opposite direction to the clean gas flow.

Figure 11:
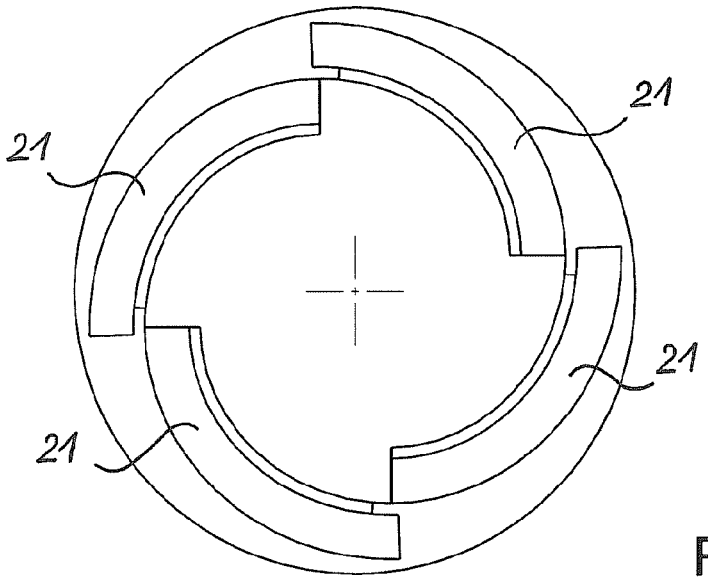
Figure 12:
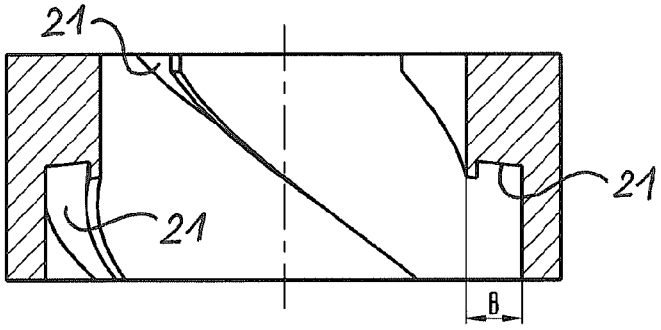
Figure 13:
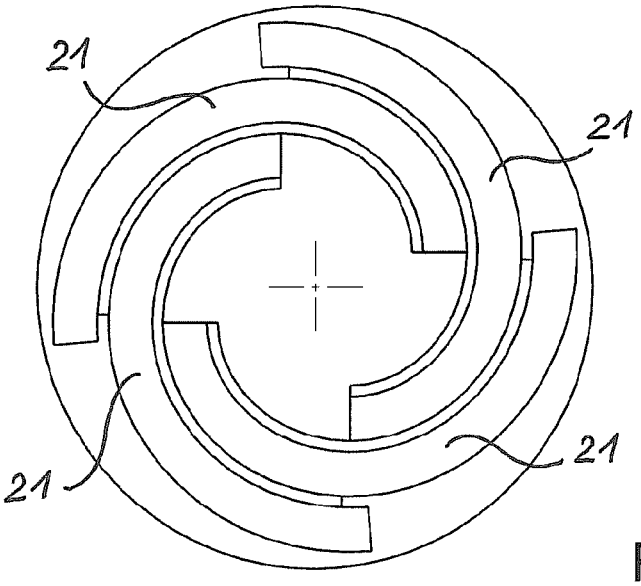

For this purpose, the quantities B (=width of the guide troughs) and n (=number of guide troughs) are also considered with reference to FIGS. 11 to 13 which show appropriate examples in a purely geometric form, wherein the width B is shown greatly enlarged for better clarity.

FIG. 11 shows schematically an example with four non-overlapping guide troughs 21 in a front view; FIG. 12 shows the same example in a longitudinal section.

FIG. 13 shows an embodiment which, in contrast to the embodiments shown in the remaining figures, differs by way of guide troughs 21 which overlap one another in the circumferential direction. Such an embodiment is likewise possible and can be manufactured without increased effort using the injection molding or diecasting method, but has the disadvantage of an increased spatial requirement.

However, it is only necessary for a guide trough to be present on the main part of the circumference in order to guarantee the function; the embodiments with non-overlapping guide troughs are therefore to be seen as particularly advantageous.

In order to guarantee that the component of the separator which has the guide trough or troughs can be removed from the mold without undercuts, the following must apply for the maximum width Bmax of the guide trough:

$$B_{max} = D * \frac{2 * \pi}{n * \Omega}$$

for demoldability; B is always D;

and simultaneously $$n \geq \frac{\Omega}{2 * \pi}$$

which means that at least one guide trough is always present on the complete circumference. For some practical examples, this then results in the following relationships for the maximum permissible width Bmax of the guide trough as a function of the radius change D which enables removal from the mold in an axial direction:

Example 1

For Ω=2*π (=360°) and n=1 (without overlap):
Bmax=D

Example 2

For Ω=π/2 (=90°) and n=4 (without overlap):
Bmax=D

Example 3

For Ω=π (=180°) and n=4 (with overlap):
Bmax=D/2

Example 4

For Ω=2*π (=360°) and n=2 (with overlap):
Bmax=D/2

This clearly shows that, with particle guide troughs which do not overlap one another in the circumferential direction, these can have a greater width than particle guide troughs which overlap one another in the circumferential direction. Embodiments other than those stated in the examples are of course possible.

As is apparent from the foregoing specification, the invention is susceptible of being embodied with various alterations and modifications which may differ particularly from those that have been described in the preceding specification and description. It should be understood that I wish to embody within the scope of the patent warranted hereon all such modifications as reasonably and properly come within the scope of my contribution to the art.

List of references:

| Symbol | Designation |
|---|---|
| 1 | Centrifugal separator |
| 10 | Separator housing |
| 11 | Housing cover |
| 11' | Sealing ring |
| 12 | Sleeve |
| 13 | Raw gas flow |
| 14 | Clean gas flow |
| 14' | Clean gas outlet |
| 15 | Particle collection trough |
| 2 | Circumferential wall |
| 20 | Inner circumference |
| 21 | Particle guide trough |
| 21.1 | Beginning of 21 (top) |
| 21.2 | End of 21 (bottom) |
| 22 | Axial particle discharge trough |
| 3 | Rotor |
| 30 | Outer circumference |
| 31 | Axis of rotation |
| 32 | Direction of rotation |
| 33 | Drive |
| a, $a_1$, $a_2$ | Distances between 20 and 30 |
| A | Height of the part of 3 which throws off particles |
| $A_1$ | Extent of height of 21 |
| $A_2$ | Extent of height of 22 |

The invention claimed is:

1. A centrifugal separator for separating liquid particles from a gas flow, comprising:

a separator housing having a rotor rotatable about an axis arranged therein, the separator housing having a raw gas inlet, a clean gas outlet and a liquid outlet as well as an imperforate circumferential wall which radially encloses an outer circumference of the rotor at a distance therefrom, the raw gas inlet axially guiding a raw gas flow into the rotor where the gas flow is set into rotation by the rotating rotor, a clean gas flow being guided away radially out of the rotor and then between the outer circumference of the rotor and an inner circumference of the circumferential wall to the clean gas outlet, the rotor having particle separation elements comprising a disc stack separator, by means of which liquid which has been separated from the gas flow is thrown off onto the inner circumference of the circumferential wall by centrifugal force when the rotor is rotating, the liquid on the circumferential wall being fed to the liquid outlet via at least one liquid guide trough in the form of an inverted groove which runs at an angle to the axis direction of the rotor and which is arranged on the inner circumference of the imperforate circumferential wall, each liquid guide trough forming a section of a conical spatial spiral defining a liquid flow path and being configured to guide the liquid along said liquid flow path of the conical spatial spiral, wherein a progression of each liquid guide trough has a radius from the axis which decreases towards the clean gas outlet in the direction of the clean gas flow, and a distance between the outer circumference of the rotor and the inner circumference of the circumferential wall becoming smaller towards the clean gas outlet in the direction of the clean gas flow.

2. The centrifugal separator as claimed in claim 1, wherein a measure of the reduction in the radius is sized depending on a width of each liquid guide trough and on the number of liquid guide troughs, so that the circumferential wall with the separator housing which has at least one liquid guide trough, can be removed from a mold axially without undercuts when manufactured as an injection molded or diecast part.

3. The centrifugal separator as claimed in claim 1, wherein each liquid guide trough extends over less than a total height of a part of the rotor which throws off liquid.

4. The centrifugal separator as claimed in claim 3, wherein the clean gas outlet is arranged above the rotor in the separator housing, the clean gas flow being guided away between the outer circumference of the rotor and the inner circumference of the circumferential wall upwards to the clean gas outlet, and each liquid guide trough beginning at the same height or above a top end of the part of the rotor which throws off liquid and extending downwards therefrom.

5. The centrifugal separator as claimed in claim 4, wherein each liquid guide trough is continued downwards into a vertical liquid discharge trough which runs axially further downwards.

6. The centrifugal separator as claimed in claim 5, wherein the distance between the outer circumference of the rotor and the inner circumference of the circumferential wall is constant over the range of height taken up by the axially running liquid discharge trough.

7. The centrifugal separator as claimed in claim 5, wherein each liquid guide trough and liquid discharge trough is undercut when viewed in cross section and is open in an opposite direction to a direction of rotation of the rotor and is formed steplessly and continuously with the inner circumference of the circumferential wall in the direction of rotation of the rotor.

8. The centrifugal separator as claimed in claim 1, wherein the circumferential wall with the at least one liquid guide trough is an integral part of the separator housing.

9. The centrifugal separator as claimed in claim 8, wherein the part of the separator housing having the at least one liquid guide trough is a housing cover which can be removed from the remaining separator housing.

10. The centrifugal separator as claimed in claim 1, wherein the circumferential wall with the at least one liquid guide trough is a sleeve which is inserted in the separator housing.

11. The centrifugal separator as claimed in claim 1, wherein a single liquid guide trough, which extends over 360° in the circumferential direction, is arranged on the inner circumference of the circumferential wall.

12. The centrifugal separator as claimed in claim 1, wherein n liquid guide troughs, each extending over 360°/n and not overlapping one another, are arranged on the inner circumference of the circumferential wall, wherein $n \geq 2$.

13. The centrifugal separator as claimed in claim 1, wherein a circumferential liquid collection trough which is connected to the liquid outlet is arranged in the separator housing below an axial bottom end of each liquid guide trough.

14. The centrifugal separator as claimed in claim 5, wherein a circumferential liquid collection trough which is connected to the liquid outlet is arranged in the separator housing below an axial bottom end of each liquid discharge trough.

15. The centrifugal separator as claimed in claim 1, wherein the centrifugal separator is an oil mist separator for the crankcase exhaust gas of an internal combustion engine.

16. The centrifugal separator as claimed in claim 15, wherein the internal combustion engine is in a motor vehicle.

17. A centrifugal separator for separating liquid particles from a gas flow, comprising:

a separator housing having a rotor rotatable about an axis arranged therein, the separator housing having a raw gas inlet, a clean gas outlet and a liquid outlet as well as a circumferential wall which radially encloses an outer circumference of the rotor at a distance therefrom, the raw gas inlet axially guiding a raw gas flow into the rotor where the gas flow is set into rotation by the rotating rotor, a clean gas flow being guided away radially out of the rotor and then between the outer circumference of the rotor and an inner circumference of the circumferential wall to the clean gas outlet, the rotor having particle separation elements comprising a disc stack separator, by means of which liquid which has been separated from the gas flow is thrown off onto the inner circumference of the circumferential wall by centrifugal force when the rotor is rotating, the liquid on the circumferential wall being fed to the liquid outlet via at least one liquid guide trough which runs at an angle to the axis direction of the rotor and which is arranged on the inner circumference of the imperforate circumferential wall, each liquid guide trough forming a section of a conical spatial spiral, wherein a progression of each liquid guide trough has a radius from the axis which decreases towards the clean gas outlet in the direction of the clean gas flow, and the outer circumference of the rotor having a cylindrical shape and the inner circumferential wall having a conical shape, narrowing in the direction towards the clean gas outlet, such that a distance between the outer circumference of the rotor and the inner circumference of the circumferential wall becomes smaller towards the clean gas outlet in the direction of the clean gas flow.

18. A centrifugal separator for separating liquid particles from a gas flow, comprising:

a separator housing having a rotor rotatable about an axis arranged therein, the separator housing having a raw gas inlet, a clean gas outlet and a liquid outlet as well as a circumferential wall which radially encloses an outer circumference of the rotor at a distance therefrom, the raw gas inlet axially guiding a raw gas flow into the rotor where the gas flow is set into rotation by the rotating rotor, a clean gas flow being guided away radially out of the rotor and then between the outer circumference of the rotor and an inner circumference of the circumferential wall to the clean gas outlet, the rotor having particle separation elements comprising a disc stack separator, by means of which liquid which has been separated from the gas flow is thrown off onto the inner circumference of the circumferential wall by centrifugal force when the rotor is rotating, the liquid on the circumferential wall being fed to the liquid outlet via at least one liquid guide trough which runs at an angle to the axis direction of the rotor and which is arranged on the inner circumference of the circumferential wall, each liquid guide trough being in the form of an elongated groove formed by two side walls and a bottom wall along the inner circumference of the circumferential wall, wherein an inner surface of one of the side walls is flush with the circumferential wall and an outer surface of the other of the side walls is flush with the circumferential wall, each liquid guide trough forming a section of a conical spatial spiral, wherein the progression of each liquid guide trough has a radius which decreases towards the clean gas outlet in the direction of the clean gas flow, and a distance between the outer circumference of the rotor and the inner circumference of the circumferential wall becoming smaller towards the clean gas outlet in the direction of the clean gas flow.

* * * * *